US007837307B2

(12) United States Patent
Schmitt

(10) Patent No.: US 7,837,307 B2
(45) Date of Patent: Nov. 23, 2010

(54) SYSTEM FOR CONTROLLING DROPLET VOLUME IN CONTINUOUS INK-JET PRINTER

(75) Inventor: Peter Schmitt, Würzburg (DE)

(73) Assignee: KBA-Metronic AG, Veitshochheim (DE)

( * ) Notice: Subject to any disclaimer, the term of this patent is extended or adjusted under 35 U.S.C. 154(b) by 486 days.

(21) Appl. No.: 11/901,950

(22) Filed: Sep. 19, 2007

(65) Prior Publication Data

US 2008/0074477 A1 Mar. 27, 2008

(30) Foreign Application Priority Data

Sep. 21, 2006 (DE) ..... 10 2006 045 060

(51) Int. Cl.
*B41J 2/09* (2006.01)
*B41J 2/12* (2006.01)

(52) U.S. Cl. ..... 347/77; 347/5; 347/6; 347/54; 347/55; 347/73; 347/74; 347/75; 347/76; 347/78; 347/79; 347/80

(58) Field of Classification Search ..... 347/75, 347/76, 77, 78, 79, 80
See application file for complete search history.

(56) References Cited

U.S. PATENT DOCUMENTS

| | | | | |
|---|---|---|---|---|
| 3,060,429 A | | 10/1962 | Winston | |
| 3,846,800 A | * | 11/1974 | Chen | 347/76 |
| 3,979,756 A | * | 9/1976 | Helinski et al. | 347/75 |
| 4,217,595 A | * | 8/1980 | Horike et al. | 347/80 |
| 4,468,679 A | * | 8/1984 | Suga et al. | 347/10 |
| 5,285,215 A | * | 2/1994 | Liker | 347/11 |
| 5,722,479 A | | 3/1998 | Oeftering | |
| 5,889,538 A | * | 3/1999 | Kishimoto et al. | 347/43 |
| 6,059,393 A | * | 5/2000 | Takahashi | 347/11 |
| 6,086,189 A | * | 7/2000 | Hosono et al. | 347/70 |
| 6,164,748 A | * | 12/2000 | Taneya et al. | 347/15 |
| 6,331,040 B1 | * | 12/2001 | Yonekubo et al. | 347/15 |
| 6,478,414 B2 | * | 11/2002 | Jeanmaire | 347/77 |
| 7,004,555 B2 | * | 2/2006 | Sugahara | 347/9 |
| 7,380,895 B2 | * | 6/2008 | Sugahara | 347/9 |
| 2005/0122381 A1 | * | 6/2005 | Golombat et al. | 347/77 |

FOREIGN PATENT DOCUMENTS

| | | |
|---|---|---|
| DE | 26 26 529 | 12/1976 |
| EP | 0 194 852 | 9/1986 |
| JP | 2006082376 | 3/2006 |
| WO | 95/11807 | 5/1995 |

* cited by examiner

*Primary Examiner*—Ryan Lepisto
(74) *Attorney, Agent, or Firm*—Andrew Wilford

(57) ABSTRACT

In an ink-jet printing a succession of ink droplets are projected along a longitudinal trajectory at a target substrate. A group of droplets is selected from the succession in the trajectory, and this the group of droplets is combined by electrostatically accelerating upstream droplets of the group and/or decelerating downstream droplets of the group into a single drop.

14 Claims, 6 Drawing Sheets

Fig. 1 - Prior Art

SYSTEM FOR CONTROLLING DROPLET VOLUME IN CONTINUOUS INK-JET PRINTER

FIELD OF THE INVENTION

The present invention relates to continuous ink-jet printing. More particularly this invention concerns a method of and system for controlling the droplet volume in a continuous ink-jet printer.

BACKGROUND OF THE INVENTION

Continuous ink-jet printers have been in commercial use for many years for labeling. According to the operating principle of these ink-jet printers, ink is pumped from a reservoir to a pressure chamber located in the actual print head. This pressure chamber has a gun or nozzle on the side facing the material to be printed. The nozzle may have an opening diameter of 30 μm to 200 μm. The ink is initially emitted from the nozzle in the form of a continuous ink stream, which, however, is not practical for labeling, since the print characters produced in this type of labeling are composed of individual dots created by individual ink droplets. To disperse the ink jet into individual ink droplets that are uniform and in particular of the same size, a modulation element is mounted on the pressure chamber that produces pressure fluctuations in the ink jet emitted from the print head, so that after exiting the nozzle, in particular after a short time and at a defined distance, the ink stream breaks up into individual, and in fact uniform, ink droplets.

The size of the ink droplets depends, among other factors, on the applied modulation frequency, the nozzle diameter, the ink's surface tension, and the pressure produced by the pump, and may be adjusted within the system limits specified by the combination of these parameters. Therefore, it is not possible to vary the droplet size of successive ink droplets to any significant extent.

Shortly before the ink droplets separate from the emitted ink jet, each of the ink droplets is given a predetermined electrical charge whose magnitude depends on the desired impact position on the product to be labeled. The ink has a low electrically conductivity to hold the electrical charge. During the charging process the ink droplet has not yet separated from the ink stream emitted from the nozzle of the ink-jet printer, so that as a result of the electrical influence, free charge carriers in the ink are moved either toward or away from the charging electrode, depending on the polarity and intensity of an external charging voltage, and the ink chamber and thus the ink reservoir, for example, are electrically held at ground potential. The charging electrode has no mechanical contact with the ink stream.

When the ink droplet separates from the ink jet while it is in the field region of the charging electrode, the influenced electrical charges that have migrated into the droplets remain in the droplet that has an external electrical charge, even after the separation. If the charging electrode is positively charged, for example, when the ink jet enters the electrical field of the charging electrode the negative free charge carriers in the ink migrate into the field, and the positively charged free charge carriers in the ink are ejected from the electrical field. A charge separation thus occurs at the front edge of the ink stream, immediately before the droplet separates, and the charge imbalance thus produced is maintained in the separating droplet, and the droplet, which in this example is negatively charged, leaves the field region of the charging electrode. Since the ink stream separates into droplets as the result of the design and operating principle, a charge remains on the separated ink droplet as described, whose magnitude corresponds to the value of the applied charging voltage at a constant electrical conductivity of the ink, so that when the charging voltage changes, the charge level may also be changed on each droplet.

On their initial linear trajectory, the electrically charged ink droplets pass into the electrostatic field of a deflecting device such as a plate capacitor, and, depending on their individual charge, are deflected to a greater or lesser degree from their linear trajectory, and after leaving the electrostatic field continue traveling at a given angle relative to their original trajectory which is a function of their charge. They eventually hit the substrate or target at a location determined by how much they were deflected, and, if the are not deflected at all, they are intercepted by a gutter and recycled back to the ink supply.

According to this system, it is possible to select different impact positions on a surface to be labeled with individual ink droplets. Normally this occurs in only one deflection direction. To eliminate individual droplets from the print image or if printing is not to be performed, as described above the ink droplets are provided with a specified fixed charge or remain uncharged, so that after emerging from the electrostatic field of the plate capacitor they strike a collection tube and are pumped back to the ink reservoir. The unprinted ink thus circulates in a circuit, adding further meaning to the term "continuous ink-jet printer."

A disadvantage of the described design is that, due to the system-related production of the ink droplets, these ink droplets always have the same size within narrow tolerances, so that a print image produced with these droplets always has the same size print dots.

In contrast, it is known from printing technology that for producing grayscales and color gradients in printed images, different sizes of print dots are used to give the observer a visual impression of grayscales or color gradients. Thus, for example, for all printing methods that use a printing plate, the individual print dots are designed with different sizes according to a pattern in production of the printing plate, resulting in different sizes of print dots in the printing.

For drop-on-demand (DOD) ink-jet printers, it is also known to use different sizes of print dots. This is achieved by the fact that during printing a differing number of uniformly sized small droplets is superimposed on the surface of the material to be printed to produce an overall larger print dot.

A disadvantage of the known methods is that they do not permit the print data to be varied within the printing process, since they operate in conjunction with printing plates, or, in the case of the DOD methods, as a result of the system and in particular in the labeling region there is only one disadvantageously small working distance of the print heads from the surface to be printed. In addition, since DOD printers always have multiple nozzles in a print head, only inks that are non-drying or slow-drying inks, or radiation-curing inks, may be used, since otherwise the inks in individual nozzles that receive little or no use dry out, causing these nozzles to fail.

Although the use of radiation-curing inks eliminates this problem, the additional use of subsequent curing appliances entails significantly greater complexity of equipment and higher costs. In addition, as a result of the typically small operating distance it is not possible to label, for example, a textured surface with high print quality, since after a short distance the trajectories of the emitted ink droplets become so unstable that a desired impact position cannot be reliably achieved, and therefore a print dot composed of multiple ink droplets can no longer be printed as a closed print dot having a defined shape.

In these systems, use of the above-mentioned inks is mandatory, since such DOD systems operate with numerous individual nozzles that may be actuated as needed. It is normal for an individual nozzle to have little or no actuation for a fairly long period of time, depending on the print image to be printed, so that when a quick-drying ink such as a solvent-containing ink is used, the ink in this nozzle dries out and the nozzle opening becomes plugged.

If this nozzle is required at a later time it is no longer available, necessitating cleaning, frequently manually, of the print head. In contrast, continuous ink-jet printers are able to print using inks that have an extremely short drying time, since the solvents used in these inks evaporate very quickly.

Since in this type of ink-jet printer the ink is continuously emitted from the nozzle, it is not possible for the nozzle to become plugged and the process to be interrupted. However, with continuous ink-jet printers of this type it has not been possible heretofore to selectively produce different sizes of ink droplets within a print image.

OBJECTS OF THE INVENTION

It is therefore an object of the present invention to provide an improved method of controlling droplet size in an ink-jet printing system.

Another object is the provision of such an improved method of controlling droplet size in an ink-jet printing system that overcomes the above-given disadvantages, in particular that works with a continuous ink-jet printer.

A further object is to provide such a droplet-size controlling method that can be used with any other type of apparatus that is suitable for producing successive ink droplets in a trajectory with essentially the same size and/or electrical charge, and in particular the same distance from one another.

SUMMARY OF THE INVENTION

An ink-jet printing method has according to the invention the steps of projecting a succession of ink droplets along a longitudinal trajectory at a target substrate, selecting a group of droplets from the succession in the trajectory, and combining the group of droplets into a single drop.

Thus according to the invention a freely selectable number of successive airborne ink droplets are combined while airborne, in particular during travel from a nozzle of an ink print head producing the droplets to the impact site on a print substrate.

It is therefore essential to the invention that different sizes of ink droplets are not initially produced, which would require complicated equipment, but instead that ink droplets having essentially the same size, preferably within narrow tolerances, are initially produced using an apparatus, for example, the previously described continuously operating ink jet print head or another apparatus for producing ink droplets. Thus, existing and established technologies may be used for producing these ink droplets, which travel in succession in their original trajectory and in particular with equidistant spacing, provided that individual droplets are not to be suppressed or masked.

The core idea of the invention is to obtain selectively different sizes of droplets, i.e. droplets with selectively different droplet volumes, by combining a selective number of successive ink droplets into a single drop. Thus, if any of the original individual droplets has a volume V, the combined single drop composed of n droplets has a volume n*v.

The combination of individual droplets between the production site, such as downstream from a pressure chamber in an ink print head, and the impact site on a substrate to be printed may occur anywhere during the overall travel time, such as, for example, before the individual original droplets are deflected, or after the original droplets have been deflected.

According to the invention, the size of a print dot on a surface to be labeled is determined by the number of ink droplets combined into a single drop. Thus, for multiline labeling of a product, for example, the individual lines may be printed with different sizes of print dots, or individual characters or even individual print dots may be printed with a different print dot size within a printed line in order to achieve, for example, better display of special effects, highlights, or gradients, in particular on rounded edges of logos or special characters.

According to the invention, therefore, ink droplets of equal size having a specified repetition frequency are produced in a first step, for example, using any given droplet producer, in particular, as previously described, by pumping ink via from an ink reservoir into a pressure chamber having a nozzle at one end. A modulation element mounted on the pressure chamber modulates the pressure in the pressure chamber in such a way that the ink jet emitted from the nozzle, in particular according to a defined short distance, breaks up into individual ink droplets having essentially the same size.

A charging device mounted immediately downstream from the nozzle (in the direction of travel downstream from the nozzle toward the target or substrate) imparts to each exiting ink droplet an electrostatic charge as described above. According to the invention, the exiting ink droplets, in particular ink droplets from a droplet train or a droplet group, from which a single, larger ink drop is to be formed in a subsequent step, may be provided with a constant charge that is essentially the same for all droplets.

To combine a desired number of individual original droplets, according to the invention velocity of the ink droplets is changed individually and/or selectively, that is they are accelerated or decelerated, by means of an electrical field, in particular in an electrode assembly, acting essentially in the direction of travel of the droplets. For this purpose it is important that all individual ink droplets to be combined initially have the same velocity in one direction. This may be the original direction, or also a deflected direction. By passing the droplets to be combined through an electrical field whose field lines run at least essentially parallel to the direction of travel of the droplets, the droplets may be individually accelerated or decelerated as a function of the intensity and direction of the electrical field. The droplets in a droplet group that pass through such an electrical field may then be combined when a different electrical field acts on the various droplets in the droplet group.

An apparatus for generating such an electrical field may be formed, for example, by an electrode assembly, in particular containing at least two electrodes positioned one behind the other in the direction of travel of the droplets, that is along the extension direction of the droplets' trajectory. These electrodes may be positioned such that they are perpendicular to the direction of travel of the ink droplets. The electrodes may be plates having essentially any given shape, having a central hole forming a passage through which the droplets pass essentially parallel to the plate surface, so that they are basically annular.

When passing through such an electrode assembly, the droplets in a droplet group may each be accelerated or decelerated differently by means of an adjustable voltage between the electrodes of the electrode assembly, so that the leading droplets in the droplet group are decelerated, and the droplets lagging behind are accelerated. Thus, the lagging droplets in the droplet group catch up with the leading droplets, and the droplets may be combined into a single drop having a larger volume. This may be done by combining the droplets into a single drop only after the droplets in the droplet group have traveled a distance after leaving the electrode assembly, in particular shortly after leaving the electrode assembly. Because of many effects—gravity, surface tension, wind resistance, a "drafting" effect—closely following liquid droplets will inevitably merge when spaced apart by less than a predetermined spacing.

With regard to an ink-jet printer as previously described, an apparatus for combining the ink droplets may be placed either upstream or downstream from a deflecting device for the ink droplets. Placement upstream from a deflecting device has the advantage that the electrode assembly may be aligned exactly perpendicular to the original direction of travel. When placed downstream from a deflecting device, the ink droplets or groups of ink droplets may have many different directions. An electrode assembly composed of two or more parallel electrodes may therefore be configured for only one designated direction, exactly perpendicular to the direction. For the other possible direction, this alignment may be only approximately correct.

However, according to the invention the electrodes in the electrode assembly may be adapted to the deflection direction of the droplets in such a way that, for any direction of the ink droplets downstream from the one deflection direction, the surface normals of the electrodes, in particular at the entry point of the droplets into the electrode assembly, are parallel to the direction of the ink droplets. For this purpose the electrodes may, for example, have a design that is curved about a center point.

In another preferred design, the distance between the electrodes in the electrode assembly may be less than or equal to the average distance between the ink droplets passing through the electrodes. This ensures that at any time only one ink droplet from an ink droplet group that is to be combined is located between the electrodes, and the electrical field therefore acts only on this single ink droplet. A different field strength and field direction may thus be imparted to each individual ink droplet by changing the field during the time period between two successive droplets.

When an apparatus for combining a desired number of ink droplets is placed downstream from a deflecting device for the droplets originally produced, the original droplets may initially travel along their trajectory after production in a deflection path that may that an individual electrical cross field of variable intensity and duration, concurrently synchronous with the droplet motion, may be associated with each ink droplet, so that each of the ink droplets has a different deflection angle. In this manner it is possible to generate previously referenced droplet trains/droplet groups composed, for example, of n individual droplets, for which all or only a specified number of the individual droplets thereof may be deflected in the same spatial direction. Thus, a droplet group having a desired number of droplets may be deflected from the original direction into a desired direction.

By use of a downstream electrode assembly whose electrical field is aligned essentially along the direction of travel of the droplets, in synchronization with the droplets, in particular the droplet group, passing through the electrodes the leading droplets may be decelerated by the electrical field, and the lagging droplets may be accelerated by an electrical field of opposite polarity, so that all droplets in a droplet group, in particular after a short distance downstream from the electrode assembly, merge while airborne. Depending on the number of droplets contained in a droplet train, print drops containing any desired number of initial droplet volumes are obtained.

The electrode assembly for combining ink droplets may also be provided upstream from a deflecting device. In that case, the droplets are first combined, and the large-volume drops that are thus produced are then deflected. This may be carried out using the same deflecting device previously described. The deflecting electrical field then acts on the combined droplets in each case.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
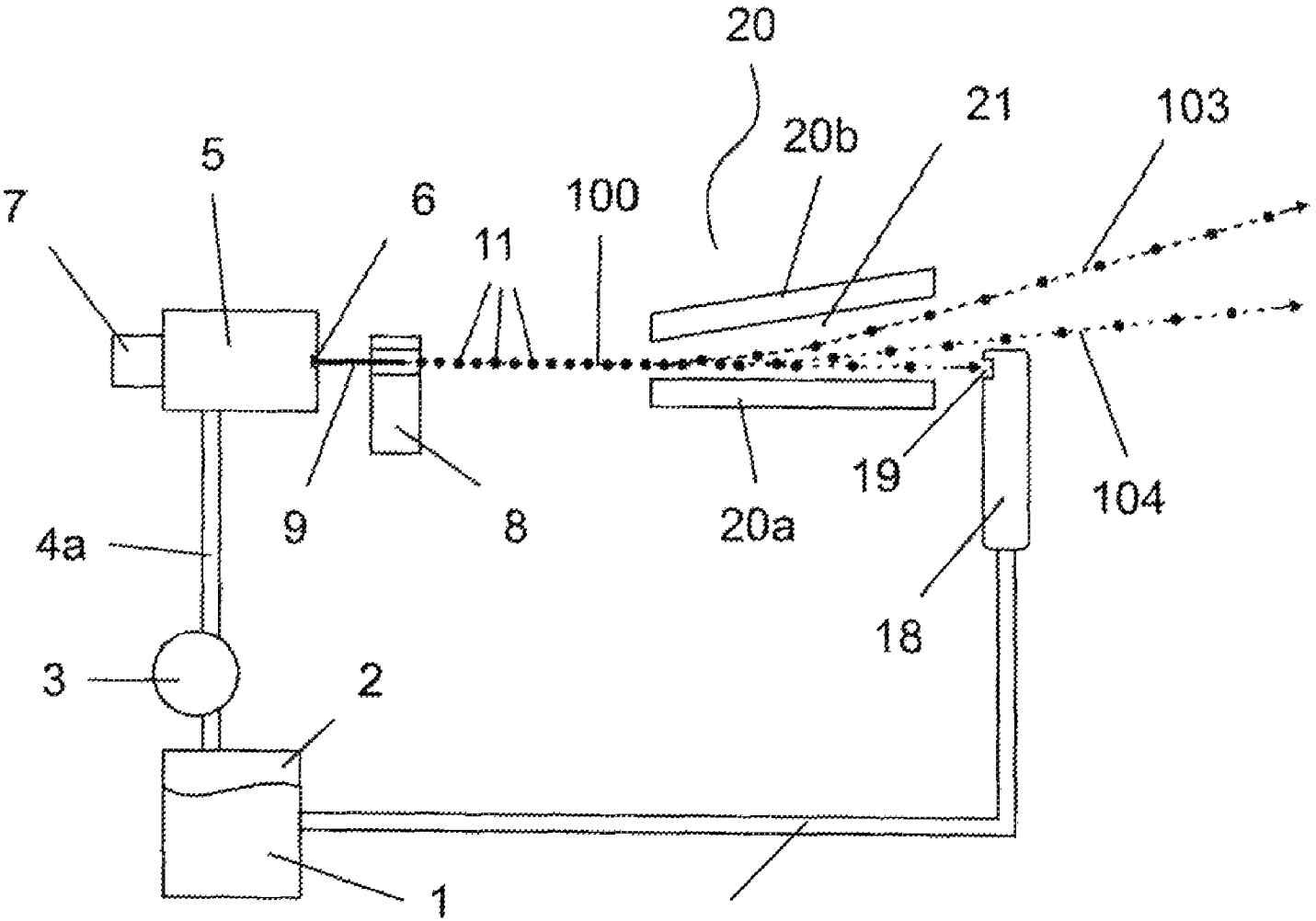
FIG. 1 is a schematic illustration of a prior-art continuous ink-jet printer.

FIG. 1 shows a print head of a known, conventional continuous ink-jet printer. Ink 1 is initially pumped from a supply reservoir 2 into the pressure chamber 5 via conduits 4*a* by means of a pump 3. A gun or nozzle 6 is provided at one end of the pressure chamber 5. Modulating devices 7 also mounted on the pressure chamber vary the pressure in the chamber 5 such that, at a short distance after emerging, the continuous ink stream 9 emitted from the nozzle 6 breaks up into individual ink droplets 11 having essentially the same size. Shortly before such breaking-up, the individual ink droplets 11 are charged by an electrode 8.

Along their trajectory 100 the ink droplets 11 then pass into an electrical field 21 formed by plate electrodes 20*a* and 20*b* of a capacitor 20. Depending on the charge quantity and the polarity of the charges on the ink droplets 11, as well as the polarity and intensity of the electrical field 21 in the field space of the plate capacitor 20, the individual ink droplets 11 are deflected into along different paths 103 and 104 illustrated by way of example.

The total number of possible deflection angles depends solely on the energization levels of the charging electrode 8, and in principle is unlimited. The electrode plate 20*a* extends parallel to the trajectory 100 while the plate 20*b* diverges downstream from it, but they could be parallel.

Here the polarity and strength of the electrical field 21 are kept essentially constant, since a change in the field strength acts simultaneously on all the droplets 11 located in the field 21 when the strength or polarity is changes. This makes it impossible to influence a single droplet.

After the ink droplets 11 leave the field space 21 of the plate capacitor 20, electrostatic force no longer acts on the ink droplets 11 that maintain their new paths or trajectories 103 or 104. This results in a fan-shaped set of trajectories. Ink droplets 11 having little or no charge, for example, because they must be eliminated from the print image, are not deflected at all in the electrostatic field 21 of the plate capacitor 20, for example, and strike an opening 19 in a gutter or collection tube 18 for ink recycling back via conduits 4*b* to the ink supply 2 and is thus recycled.

Figure 2:
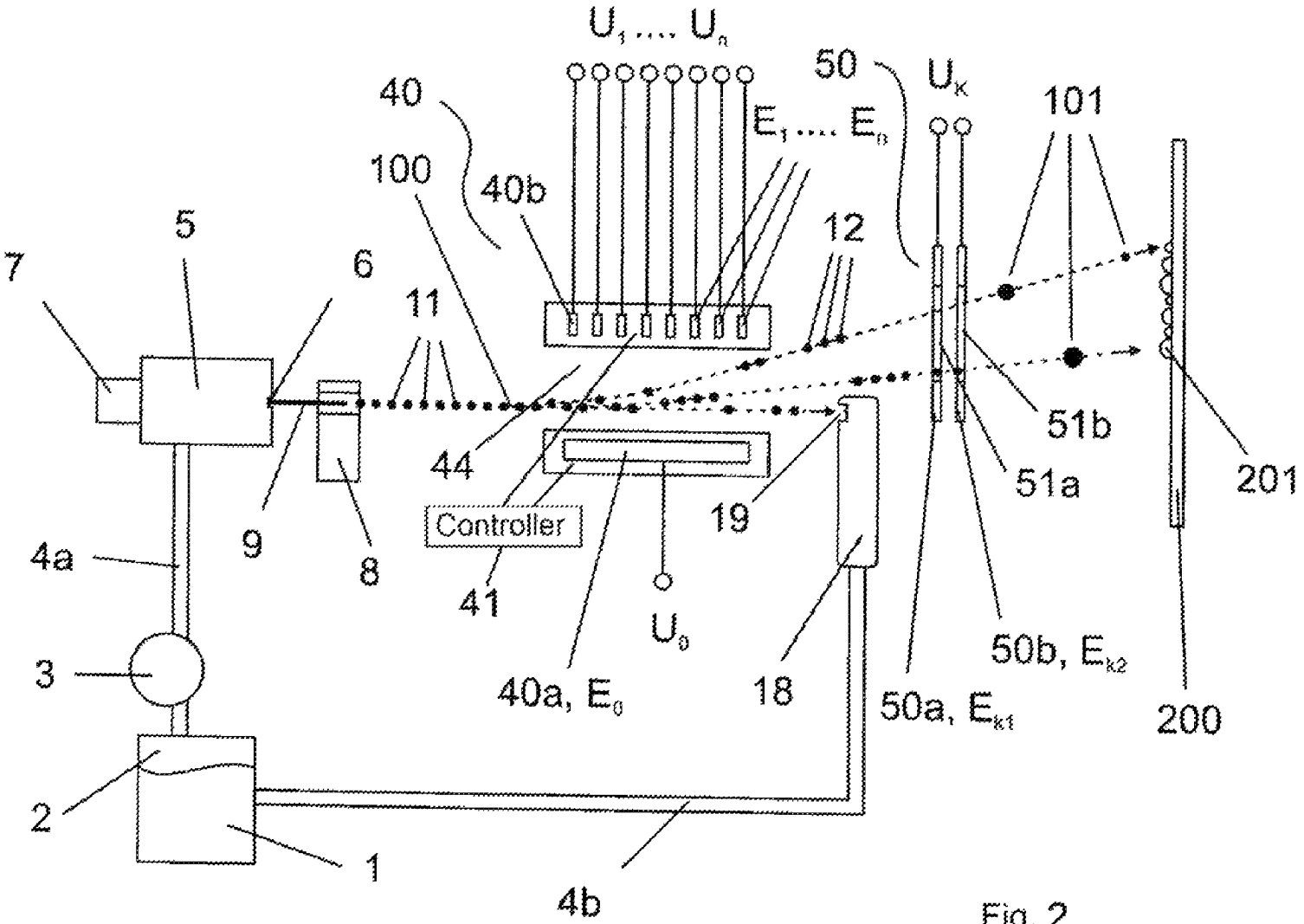
FIG. 2 is a schematic illustration of an embodiment according to the invention of a continuous ink-jet printer for producing variable droplet sizes.

FIG. 2 shows a schematic illustration of a system according to the invention for producing and deflecting ink droplets 11 having variable droplet size in a continuous ink-jet printer. The droplet themselves are produced in the manner described above with reference to FIG. 1. Of course the droplets 11 could be produced in any other way. It is instead the manner in which the droplets 11 are combined while airborne that is the invention here.

In any case, here, after the droplets 11 form, in a departure from the known design, these individual ink droplets 11 are each provided with the same electrical charge by means of the charging electrode 8.

Along their trajectory 100 the ink droplets 11 then pass through a variable electrical field 44 that is generated by an electrode assembly 40 comprised of parts 40*a* and 40*b* extending along and flanking the trajectory. The part 40*a* comprises a single electrode $E_0$ extending its full length, and the part 40*b* comprises a row extending parallel to the electrode $E_0$ of electrodes $E_1$ to $E_n$. The distances between adjacent electrodes $E_1$ to $E_n$ is the same as the distance between successive ink droplets 11.

Deflection voltages $U_0$, $U_1$ to $U_n$ are applied to the respective electrodes $E_0$ and $E_1$ by a control circuit 41. If different applied voltages are shifted downstream synchronously with the movement of the droplets 11, that is at the same velocity along the path 100, it is possible to control the lateral deflection of a single droplet, creating an effect similar to that in the prior-art system of FIG. 1. Thus to deflect a single droplet a certain amount a voltage differential is moved at the droplet-travel speed from electrode $E_1$ to electrode $E_2$ to electrode $E_3$ synchronously to pick a single droplet 11 out of the path to the recycle gutter 18. By varying the intensity and duration of the electrical field acting on each ink droplet, different deflection angles may be produced for the ink droplets 11. By discontinuing the concurrent electrical field, no deflection, for example, is imparted to the ink droplets 11 to be eliminated from the print image and recycled.

According to the invention it is also possible to deflect a plurality or group 12 of ink droplets 11. Thus, the same electrical field preferably acts on each droplet of a droplet group 12 in the deflection direction. The number of different drop sizes can be determined by a system controller and is thus not depending of the number of electrodes $E_0$-$E_n$ of the deflection unit 40. If for example a number of 8 droplets 11 per group 12 chosen, a total number of 8 different drop sizes can be realized which corresponds to a total number of 9 greyscale levels or intensities, including the case of non-printing. Corresponding to a specific grayscale a defined number of droplets of each group leaves the deflection electrode assembly 40 into one specific deflected direction, whereby the number of deflected droplets 11 in each group 12 can be different as described.

The droplet groups 12 thus produced then pass into an electrode assembly 50 comprised of electrodes 50*a* and 50*b*, i.e. $Ek_1$ and $Ek_2$, having respective openings 51*a* and 51*b*. The electrodes 50*a* and 50*b* are configured in such a way that the electrical field generated by application of an electrical voltage is directed essentially in the direction of travel of the ink droplets 11. The electrodes 50*a* and 50*b* are also designed and configured so that the ink droplets 11 pass through the openings 51*a* and 51*b* in the electrodes 50*a* and 50*b*, no matter whether they are deflected laterally only slightly, or to a maximum.

Furthermore, the distance between the electrodes 50*a* and 50*b* is such that at any time only one individual ink droplet 11 is located in the space between the electrodes 50*a* and 50*b*. If an electrical voltage Uk is then applied to the electrodes $EK_1$ and $EK_2$, an electrical field develops in this space between the electrodes $EK_1$ and $EK_2$ that, depending on its intensity and polarity, either accelerates or decelerates ink droplets 11 present in this field space.

Because only one individual ink droplet 11 is present in the space at any time, the force thus produced acts only on this ink droplet 11. By changing the intensity and/or the polarity of the applied voltage Uk, successive ink droplets 11 may thus be accelerated or decelerated to different degrees. To combine the individual ink droplets 11 in a droplet group 12 into a single ink drop 101, according to the invention the leading droplets 11 in a droplet group 12 are decelerated and the lagging droplets 11 are accelerated, such that after a short distance downstream from the electrode assembly 50 all the ink droplets 11 in the group 12 combine while airborne in a common center of gravity of the droplet group 12. This ensures that the differently sized ink drops 101 thus produced are essentially the same distance from one another, and after the ink drops 101 strike a substrate 200 a print image is obtained that contains different sizes of print dots 201 and also has a uniform distance between print dots. Normally the printing assembly and the target or substrate 200 are relatively moved in a direction perpendicular to the view plane of FIG. 2, that is perpendicular to the transverse direction in which the droplets 11 are deflected from the trajectory 100 by the electrode assembly 40.

Figure 3:
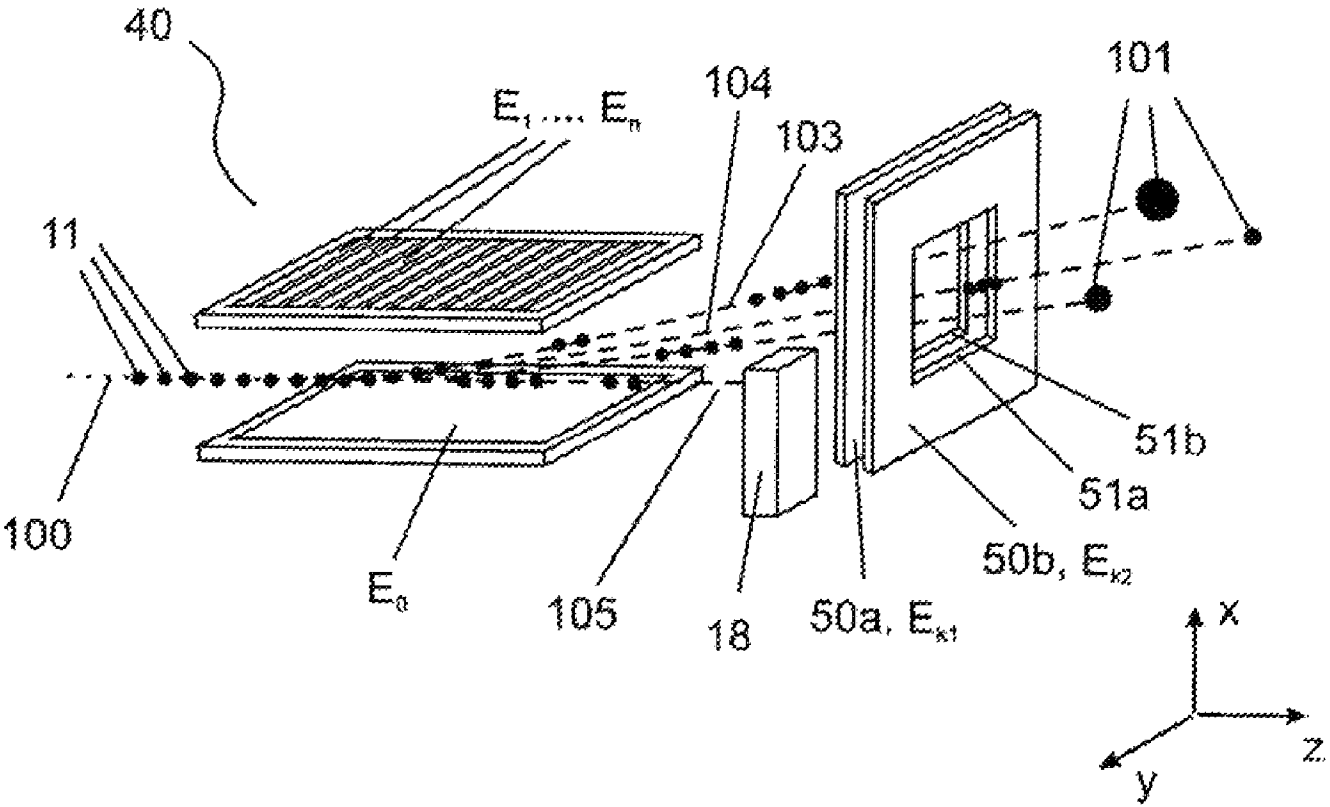
FIG. 3 is a schematic perspective illustration of an embodiment according to the invention of the electrode assembly for velocity modulation of the deflected droplets.

FIG. 3 schematically shows in a perspective illustration the deflecting device 40, the downstream electrode assembly 50, and a number of deflection paths 103, 104, and 105 for the ink droplets 11 and schematically illustrated droplet groups 12. The shapes of the electrodes 50*a* and 50*b* may be different, and may be, for example, rectangular, circular, oval, or of another shape adapted to the particular system. The same is true for the openings 51*a* and 51*b* that preferably may be designed such that the most homogeneous electrical field distribution possible is obtained in the space between the electrodes 50*a* and 50*b* traversed by the ink droplets 11. The electrode assembly 50 in the direction of travel of the ink droplets 11 may also have a cylindrical, cup-shaped, or a generally concave design, so that, regardless of the deflection angle of the respective ink droplets 11, the ink droplets 11 consistently traverse the space between the electrodes 50*a* and 50*b* in a precise path along the electrical field lines.

Figure 4A:
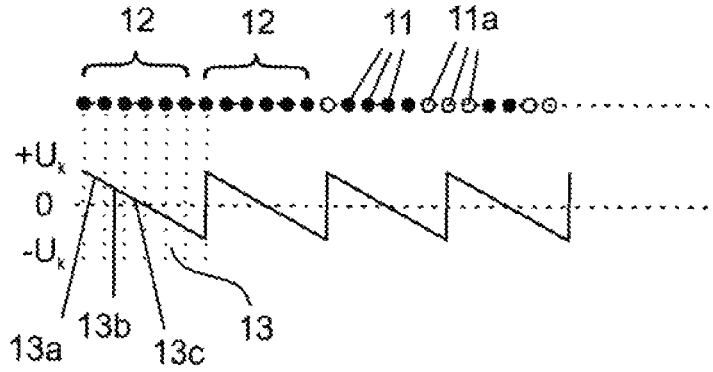
FIGS. 4*a* and 4*b* are graphs the voltage curve based on the embodiment according to the invention shown in FIG. 2 for modulating the velocity for droplet trains following in immediate succession.

FIGS. 4*a*, 4*b* and 5*a*, 5*b* schematically show the relationship of the voltage $U_k$ to the respective ink droplets 11 in the respective droplet group 12. FIG. 4*a* shows by way of example a saw-tooth curve of the voltage $U_k$ from a positive voltage $+U_k$ to a negative voltage $-U_k$, each segment 13*a*, 13*b*, 13*c* of a saw-tooth voltage interval 13 acting only on the ink droplets 11, illustrated in the drawing above the curve that at that time have traversed the electrode assembly 50. Thus, each drop is acted on only by the field intensity intended for the drop, thereby more or less strongly decelerating or accelerating the droplet.

Figure 4B:
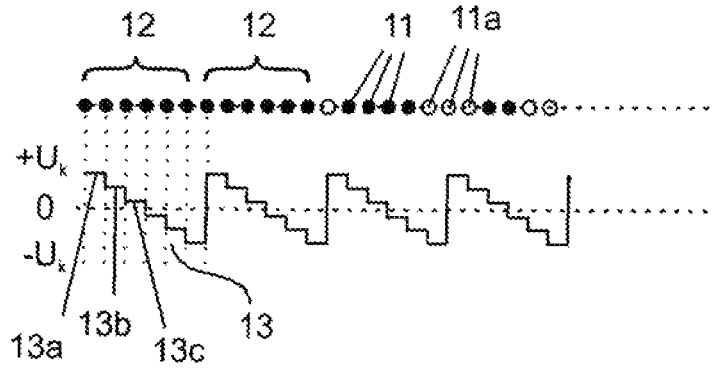
Figure 5A:
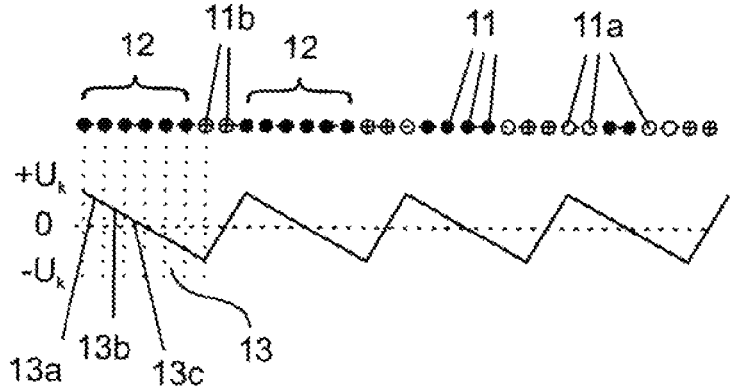
FIGS. 5*a*, 5*b* are graphs of the voltage curve based on the embodiment according to the invention shown in FIG. 2 for modulating the velocity in gaps between the successive droplet trains.
Figure 5B:
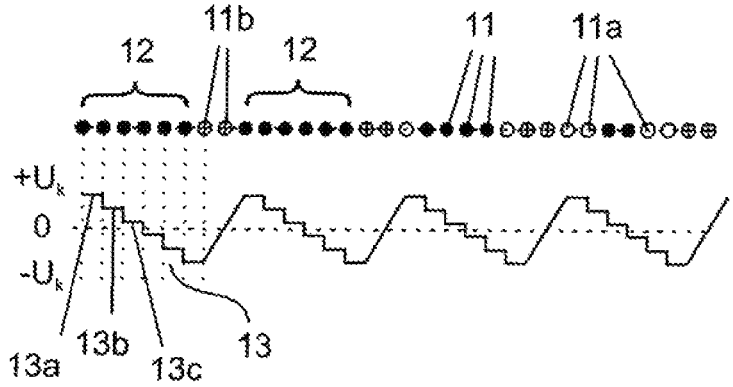

FIG. 4*b* shows by way of example another type of energization of the electrodes 50 and 50*b* by means of a stepwise voltage curve, so that a different but constant field intensity, corresponding to the voltage acting at this time in the respective segment 13*a*, 13*b*, 13*c* of the voltage interval 13, is imparted to each ink droplet upon passing through the field space. In each case it is advantageous to keep the sum of the accelerating and decelerating voltages constant, particularly preferably equal to zero. The accelerating or decelerating voltages may also have different magnitudes that in particular for the combination of odd numbers of ink droplets 11 may advantageously result in a single ink drop.

It may also be advantageous to superimpose upon each variable accelerating or decelerating voltage for each droplet group 12 a correcting voltage in such a way that deviations in position, which may occur between odd-number and even-number drop volumes, may be compensated for in the labeling plane.

Between the respective droplet groups 12, it may be practical to deflect one or more ink droplets 11 into the gutter in order to technically facilitate the voltage jump between successive droplet groups 12 from $-U_k$ to $+U_k$ illustrated in FIGS. 4*a* and 4*b*, for example. The ink droplets 11 missing at these locations are denoted by reference numeral 11*b* in FIGS. 5*a* and 5*b*. FIGS. 4*a*, 4*b*, 5*a*, 5*b* also show that, depending on the desired size of the resulting ink drop 101, it is not necessary for all ink droplets 11 to be present within a droplet group 12. These missing ink droplets 11 are denoted by reference numeral 11*a*. It is further noted that each of the illustrated droplet groups 12 may have a different deflection angle.

Figure 6:
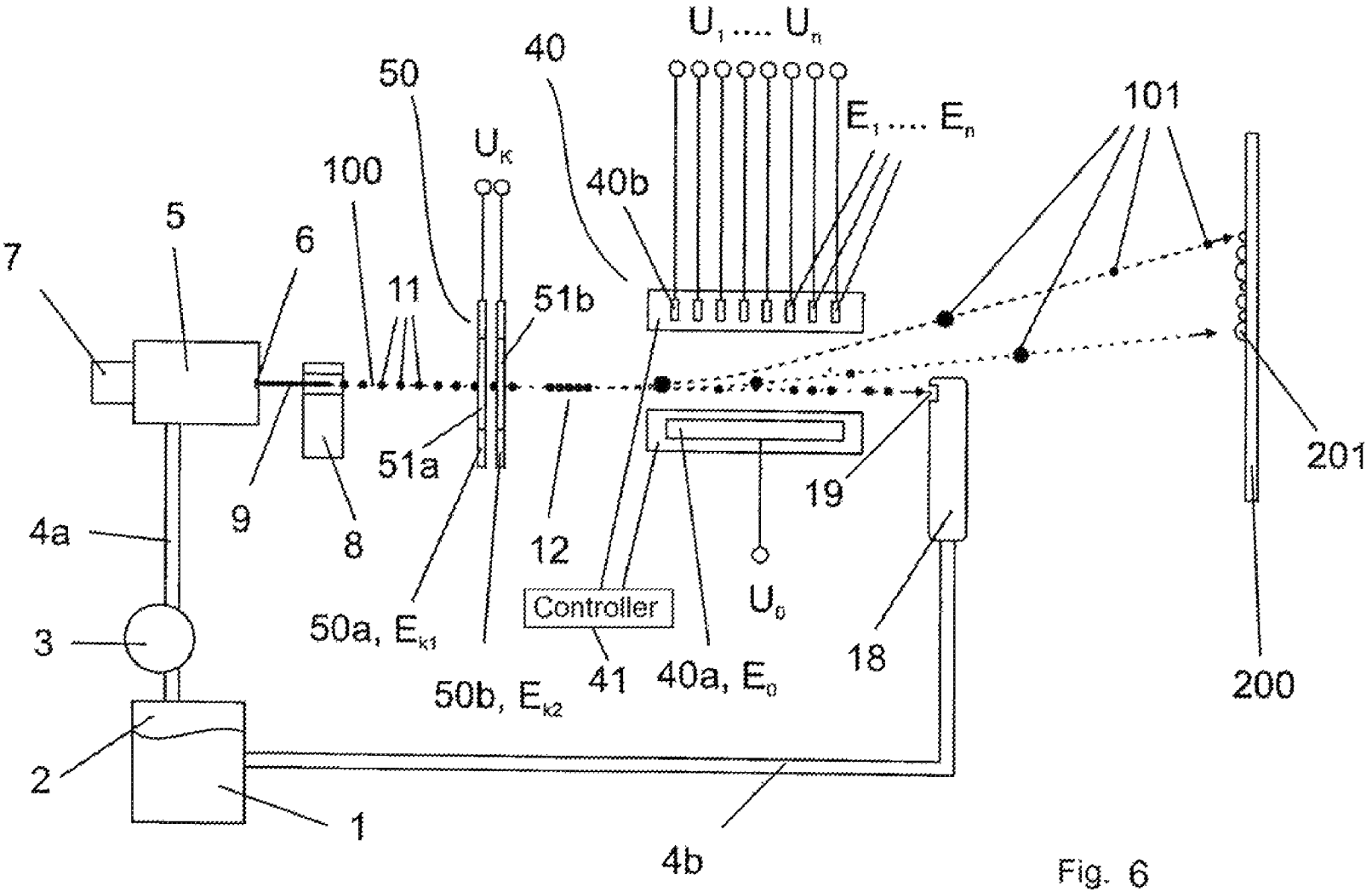
FIG. 6 is a schematic illustration of a printing apparatus having an electrode assembly for combining droplets upstream from a deflecting device.
Figure 7A:
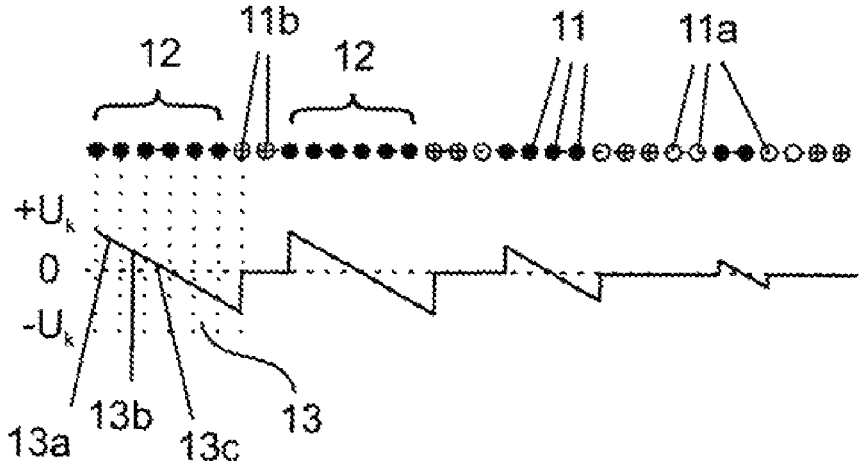
FIGS. 7*a* and 7*b* are graphs of curves for the voltages between the two electrodes in an electrode assembly according to FIG. 6 for combining the droplets.
Figure 7B:
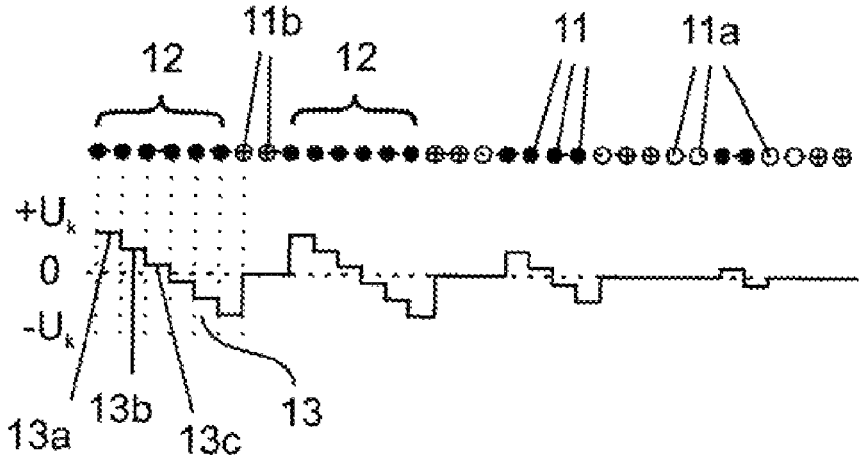

In another embodiment shown in FIG. 6, the individual ink droplets 11 in a droplet group 12 are combined upstream from the deflecting device formed from the electrode assembly 40 by means of the electrode assembly 50, so that in the deflecting device 40 different sizes of ink droplets 11 may be united corresponding to the desired impact position on a substrate to be printed. In this case, the droplets 11 for the drops to be combined are accelerated or decelerated in the described manner, whereas the voltage $U_k$ for the drops to be masked but is set to zero, as shown in FIGS. 7*a* and 7*b*.

I claim:

1. An ink-jet printing method comprising the steps of:

projecting a succession of ink droplets along a longitudinal trajectory at a target substrate;

imparting to all of the droplets at a charge location along the trajectory a substantially identical charge;

selecting a group of droplets from the succession in the trajectory; and combining the group of droplets into a single drop.

2. The method defined in claim 1 wherein the droplets are emitted at a starting end of the trajectory from a nozzle and all have the same size.

3. The method defined in claim 1 wherein the droplets are decelerated or accelerated by passing them through an electrostatic field extending along the trajectory to combine the droplets into a single drop.

4. The method defined in claim 3 wherein the electrostatic field is created by a pair of electrodes spaced apart parallel to the trajectory.

5. The method defined in claim 4 wherein a strength of the electrostatic field is varied as the droplets of the group pass the electrodes.

6. An ink-jet printing method comprising the steps of:

projecting at a target substrate a succession of ink droplets along a longitudinal trajectory between a pair of electrodes;

charging the electrodes to create an electrostatic field through which the electrodes pass;

spacing the electrodes parallel to the trajectory by a distance equal generally to a spacing between succeeding droplets of the succession;

selecting a group of droplets from the succession in the trajectory; and varying a strength of the electrostatic field and thereby decelerating or accelerating droplets of the group to combine the group of droplets into a single drop.

7. An ink-jet printer comprising:

nozzle means for projecting a succession of ink droplets along a longitudinal trajectory at a target substrate;

a pair of charged electrodes flanking the path and spaced apart by a distance equal at most to a spacing between succeeding droplets of the succession;

means for selecting a group of droplets from the succession in the trajectory; and means for applying a varying potential to the electrodes such that individual droplets passing between the electrodes are accelerated or decelerated and the droplets of the group are combined into a single drop, whereby the drop then strikes the target substrate.

8. The ink-jet printer defined in claim 7 wherein the electrodes are annular and form a passage through which the trajectory passes.

9. The ink-jet printer defined in claim 7 wherein the means for selecting can vary the number of droplets in the group.

10. The ink-jet printer defined in claim 9, wherein the means for selecting includes a control unit and a software to define the number of droplets in the group.

11. An ink-jet printer comprising:

nozzle means for projecting a succession of ink droplets of the same size along a longitudinal trajectory at a target substrate;

means for identically charging all the droplets at a charging location along the trajectory;

a pair of electrodes flanking the path;

means for selecting a group of droplets from the succession in the trajectory; and control means for applying to the electrodes a varying potential such that the droplets of the group are accelerated or decelerated and combined into a single drop, whereby the drop then strikes the target substrate.

12. The ink-jet printer defined in claim 11 wherein the charging means is upstream of the means for selecting and of the control means.

13. An ink-jet printer comprising:

nozzle means for projecting a succession of ink droplets along a longitudinal trajectory at a target substrate;

an electrode assembly having to one side of the trajectory a main electrode of predetermined length measured parallel to the trajectory equal at least to a length of a biggest possible group to be selected and to an opposite side of the trajectory a row of secondary electrodes spaced apart by a distance equal generally to a spacing between succeeding droplets of the succession;

means for selecting a group of droplets from the succession in the trajectory; and control means for applying varying voltages to the secondary electrodes and thereby combining the group of droplets into a single drop, whereby the drop then strikes the target substrate.

14. The ink-jet printer defined in claim 13 wherein the control means applies to the secondary electrodes voltages that vary sawtooth fashion synchronously with movement of the droplets along the trajectory.

* * * * *